US007530506B2

(12) United States Patent
Kato et al.

(10) Patent No.: US 7,530,506 B2
(45) Date of Patent: May 12, 2009

(54) FUEL INJECTION VALUE

(75) Inventors: Hideo Kato, Tochigi (JP); Tomoichi Misawa, Gunma (JP); Nobuaki Kobayashi, Gunma (JP); Nobutaka Ishii, Gunma (JP)

(73) Assignee: Hitachi, Ltd., Tokyo (JP)

( * ) Notice: Subject to any disclaimer, the term of this patent is extended or adjusted under 35 U.S.C. 154(b) by 1259 days.

(21) Appl. No.: 10/442,265

(22) Filed: May 21, 2003

(65) Prior Publication Data

US 2003/0218081 A1 Nov. 27, 2003

(30) Foreign Application Priority Data

May 21, 2002 (JP) ..... 2002-146260

(51) Int. Cl.
*F02M 51/00* (2006.01)

(52) U.S. Cl. ..... 239/585.1; 239/585.4; 239/900

(58) Field of Classification Search ..... 239/585.1, 239/585.2, 585.3–585.5, 900
See application file for complete search history.

(56) References Cited

U.S. PATENT DOCUMENTS 5,033,716 A * 7/1991 Mesenich ..... 251/129.21
5,190,223 A * 3/1993 Mesenich ..... 239/585.5
5,275,341 A 1/1994 Romann et al.
6,257,509 B1 * 7/2001 Hafner et al. ..... 239/585.1

FOREIGN PATENT DOCUMENTS

| | | |
|---|---|---|
| DE | 689 13 215 T2 | 7/1994 |
| DE | 198 29 422 A1 | 1/2000 |
| DE | 100 39 083 A1 | 2/2002 |
| JP | 2000-8990 | 1/2001 |

* cited by examiner

*Primary Examiner*—Christopher S Kim
(74) *Attorney, Agent, or Firm*—Antonelli, Terry, Stout & Kraus, LLP.

(57) ABSTRACT

A valve element of a fuel injection valve comprises a cylindrical structural base which has an upper end contactable with a lower end of a core tube installed in a cylindrical case and a spherical valve head which is contactable with a valve seat arranged at a lower end of the cylindrical case. The structural base is a sintered magnetic metal member produced through a metal powder injection molding method and has a relative density ranging from approximately 95% to approximately 98%, and the structure base has, at the end thereof that is contactable with the downstream end of the core tube, a notched surface for suppressing an undesirable sticking of the end of the structural base to the downstream end of the core tube.

7 Claims, 7 Drawing Sheets

FUEL INJECTION VALUE

BACKGROUND OF INVENTION

1. Field of Invention

The present invention relates to fuel injection valves for use in internal combustion engines.

2. Description of Related Art

Various types of fuel injection valves have been hitherto proposed and put into practical use particularly in the field of automotive internal combustion engines. One of them is disclosed in Laid-open Japanese Patent Application (Tokkai) 2000-8990, which generally comprises a valve element arranged in a casing to move between open and close positions and an electromagnetic coil arranged to actuate the valve element to move between the open and close positions in accordance with energization/de-energization of the electromagnetic coil. Upon opening of the valve element, a pressurized fuel in a fuel passage of the casing is injected into a given space, such as a combustion chamber, air intake passage or the like, of the internal combustion engine.

However, due to inherent construction, the fuel injection valves of the type disclosed by the above-mentioned Japanese Application tend to fail to exhibit a satisfied dimensional stability of the valve element. That is, for producing the valve element, a press working is employed to shape a given portion of the valve element, which however tends to induce a deformation or swelling of the given portion to which the pressing force is actually applied. As is known, such deformation or swelling (viz., dimensional poorness) induces a non-smoothed movement of the valve element and thus tends to exhibit a poor responsiveness of the same upon energization/de-energization of the electromagnetic coil. If, for smoothing the movement, a finish machining working is additionally employed for finely shaping the valve element, productivity of the fuel injection valve is lowered and thus cost performance of the same becomes poor.

SUMMARY OF INVENTION

Accordingly, it is an object of the present invention to provide a fuel injection valve which is free of the above-mentioned drawbacks.

According to the present invention, there is provided a fuel injection valve which comprises a valve element that is axially movable between open and close positions in response to energization and de-energization of an electromagnetic coil, the valve element having a base portion that is constructed of a sintered magnetic metal and an axial end that is shaped to suppress undesired sticking of the valve element which would occur at the open position.

According to a first aspect of the present invention, there is provided a fuel injection valve which comprises a cylindrical case constructed of a magnetic metal, the metal case including an upstream end through which a pressurized fuel is led into a fuel passage defined in the metal case and a downstream end from which the fuel is injected to a given portion through fuel injection nozzles; a core tube constructed of a magnetic metal, the core tube being received in the cylindrical case and having an upstream end facing the upstream end of the cylindrical case and a downstream end facing the downstream end of the cylindrical case; a valve seat member provided at the downstream end of the cylindrical case at a position upstream of the fuel injection nozzles; a valve element axially movably received in the cylindrical case between the core tube and the valve seat member, the valve element including a structural base that is directed toward the downstream end of the core tube and a valve head that is directed toward the valve seat member; a biasing member that biases the valve element toward the valve seat member; and an electromagnetic coil that forces the valve element to move toward the downstream end of the core tube against the biasing force of the biasing member when energized, wherein the structural base of the valve element is a sintered magnetic metal member produced through a metal powder injection molding method and has a relative density ranging from approximately 95% to approximately 98%, and wherein the structure base has, at an end thereof that is contactable with the downstream end of the core tube, a notched surface for suppressing a sticking of the end of the structural base to the downstream end of the core tube.

According to a second aspect of the present invention, there is provided method of producing a cylindrical structural base of a valve element which comprises producing a cylindrical green compact through a metal powder injection molding method; sintering the cylindrical green compact to produce a first cylindrical unfinished compact; machining the first cylindrical unfinished compact to produce a second cylindrical unfinished compact; and applying a press working to the second cylindrical unfinished compact to produce a finished compact that is the structural base, the finished compact having at one end thereof a notched surface including a plurality of notches.

BRIEF DESCRIPTION OF DRAWINGS

Other objects and advantages of the present invention will become apparent from the following description when taken in conjunction with the accompanying drawings, in which.

DETAILED DESCRIPTION OF INVENTION

In the following, a fuel injection valve of the present invention will be described in detail with reference to the accompanying drawings.

For ease of understanding, various directional terms, such as, right, left, upper, lower, rightward and the like are used in the following description. However, such terms are to be understood with respect to only a drawing or drawing on which a corresponding portion or part is shown.

Figure 1:
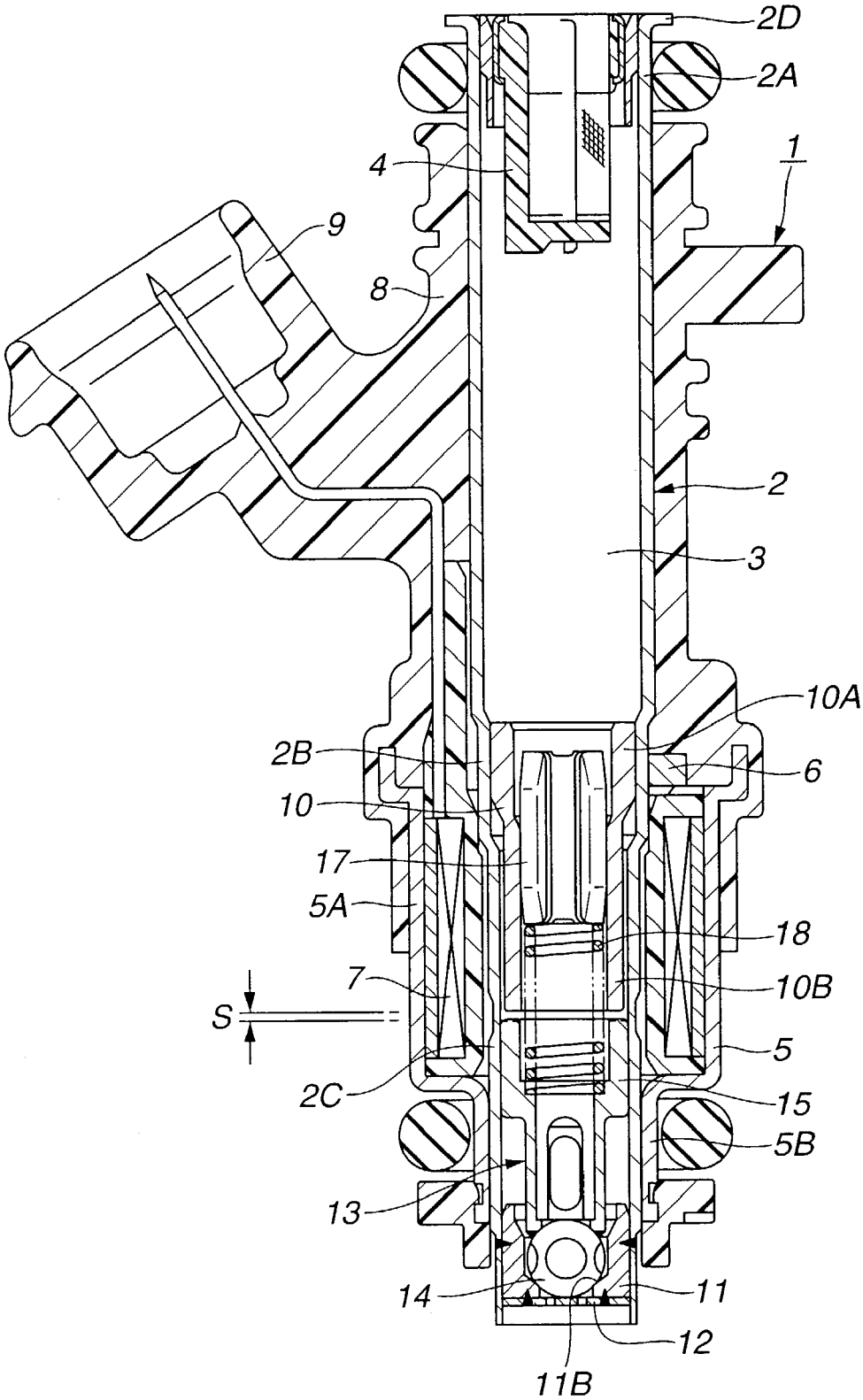
FIG. 1 is a vertically sectional view of a fuel injection valve according to the present invention.
Figure 2:
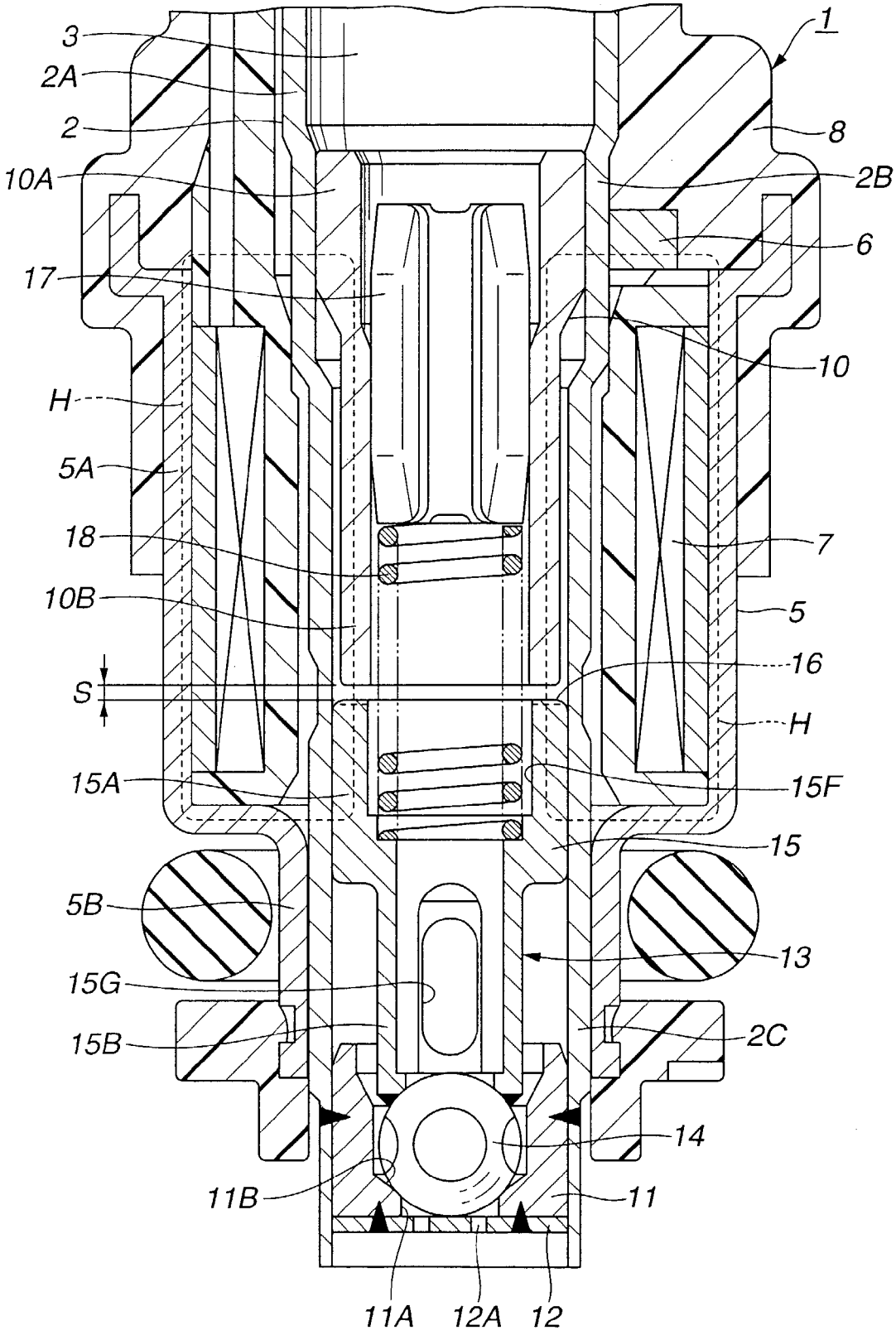
FIG. 2 is an enlarged sectional view of an essential portion of the fuel injection valve of the invention.

Referring to FIGS. 1 and 2, particularly FIG. 1, there is shown a fuel injection valve of the invention, which comprises a case structure 1.

As will be described in detail hereinafter, case structure 1 generally comprises a cylindrical metal case 2 of magnetic material, an annular metal yoke 5 of magnetic material and a plastic cover 8 that covers case 2 and yoke 5.

Cylindrical metal case 2 forms a constructional base of case structure 1. Magnetic stainless steel may be used as a material of the metal case 2. As shown, the metal case 2 has a stepped lower portion. That is, metal case 2 comprises a larger diameter upper portion 2A, a smaller diameter lower portion 2C and a medium diameter middle portion 2B through which upper and lower portions 2A and 2C are connected, as shown.

Upper portion 2A of metal case 2 is formed at its upper end with a flange 2D that extends radially outward. Within upper portion 2A of metal case 2, there is installed a fuel filter 4.

Metal case 2 has a cylindrical fuel passage 3 defined therein. Although not shown in the drawing, the upper open end of metal case 2 is connected with a fuel feeding pipe that leads to a fuel pump. Thus, under operation of the fuel pump, cylindrical fuel passage 3 is filled with a pressurized fuel supplied from the pump. As shown, fuel passage 3 extends downward to a lower end of metal case 2 where a valve seat member 11 is arranged.

Fuel filter 4 is press-fitted in the upper portion of metal case 2 for cleaning or filtering the pressurized fuel that is led into fuel passage 3 of metal case 2 from the fuel pump.

Annular metal yoke 5 is concentrically disposed around the stepped lower portion of metal case 2. Metal yoke 5 comprises a larger diameter upper portion 5A that concentrically covers an electromagnetic coil 7 concentrically disposed about the lower portion of metal case 2, and a smaller diameter lower portion 5B that is tightly disposed on a lower half of smaller diameter lower portion 2C of metal case 2.

Between larger diameter upper portion 5A of metal yoke 5 and medium diameter middle portion 2B of the same, there is interposed a generally C-shaped connecting core 6 that grips the middle portion 2B. Connecting core 6 is constructed of a magnetic metal.

As shown, electromagnetic coil 7 is interposed between medium diameter middle portion 2B of metal case 2 and larger diameter upper portion 5A of metal yoke 5. As will be described hereinafter, electromagnetic coil 7, metal case 2, yoke 5 and an after-mentioned core tube 10 constitute an electromagnetic actuator.

As is seen from FIG. 2, when electromagnetic coil 7 becomes energized, closed magnetic circuits "H" are produced which extend through metal yoke 5, smaller diameter lower portion 2C of metal case 2, core tube 10, a cylindrical structural base 15 of an after-mentioned valve element 13 and connecting core 6.

Referring back to FIG. 1, plastic cover 8 covers larger diameter upper portion 2A of metal case 2. For this covering, a so-called insert molding technique is used. That is, after assembling metal case 2, metal yoke 5, connecting core 6 and electromagnetic coil 7 in a cavity of a mold (not shown), a molten plastic material is injected into the cavity, and after the plastic material is cured to have a sufficient hardness, an integrated product, viz., the assembly covered with plastic cover 8, is released from the mold. As shown, plastic cover 8 is formed with a boss portion that is shaped into a connector socket 9.

As shown, core tube 10 is press-fitted in the stepped lower portion of metal case 2, which is constructed of a magnetic metal. For matching with the shape of the stepped lower portion of metal case 2, core tube 10 has a shape comprising a larger diameter upper part 10A that is fitted in medium diameter intermediate portion 2B of metal case 2 and a smaller diameter lower part 10B that is received in smaller diameter lower portion 2C of metal case 2 having a thin annular clearance left therebetween. As will be described in detail hereinafter, upon energization of electromagnetic coil 7, core tube 10 cooperates with cylindrical structural base 15 of valve element 13 and metal yoke 5 to generate the closed magnetic circuits "H" as is shown in FIG. 2. Upon generation of the closed magnetic circuits "H", a cylindrical upper part 15A of structural base 15 of valve element 13 is attracted by the circuits "H" and thus valve element 13 is moved up toward core tube 10 against a biasing force of a coil spring 18 to induce an open condition of the fuel injection valve of the invention. That is, in this condition, a spherical valve head 14 of valve element 13 is released from a valve seat 11B of valve seat member 11.

As is seen from FIG. 2, when core tube 10 is properly set in metal case 2, a lower annular end of smaller diameter lower part 10B of core tube 10 faces an upper annular end of cylindrical part 15A of structural base 15 of valve element 13 leaving a given space "S" therebetween. That is, the given space "S" is provided for permitting an upward movement of valve element 13 for achieving the open condition of the fuel injection valve of the invention. In other words, the lower annular end of smaller diameter lower part 10B of core tube 10 functions to restrict the upward movement or open degree of valve element 13.

As is best seen in FIG. 2, valve seat member 11 is tightly received in the lower end of smaller diameter lower portion 2C of metal case 2. Valve seat member 11 is formed at a portion just below valve seat 11B with a fuel injection opening 11A. As shown, valve seat 11B has a tapered contact surface to which spherical valve head 14 is hermetically contactable. Preferably, the contract surface of valve seat 11B is shaped concave to intimately match the shape of spherical valve head 14.

Below valve seat member 11, there is disposed a nozzle plate 12 that is welded to a lower end surface of valve seat member 11. Nozzle plate 12 is formed with a plurality of fuel injection nozzles 12A that are exposed to fuel injection opening 11A of valve seat member 11.

As shown, valve element 13 is installed in smaller diameter lower portion 2C of metal case 2 and axially movable between core tube 10 and valve seat member but by a given slight degree.

Valve element 13 comprises the cylindrical structural base 15 that axially slidably contacts with an inner surface of smaller diameter lower portion 2C of metal case 2 and the spherical valve head 14 that is fixed to a lower end of structural base 15 and hermetically contactable with valve seat 11B of valve seat member 11.

Figure 3:
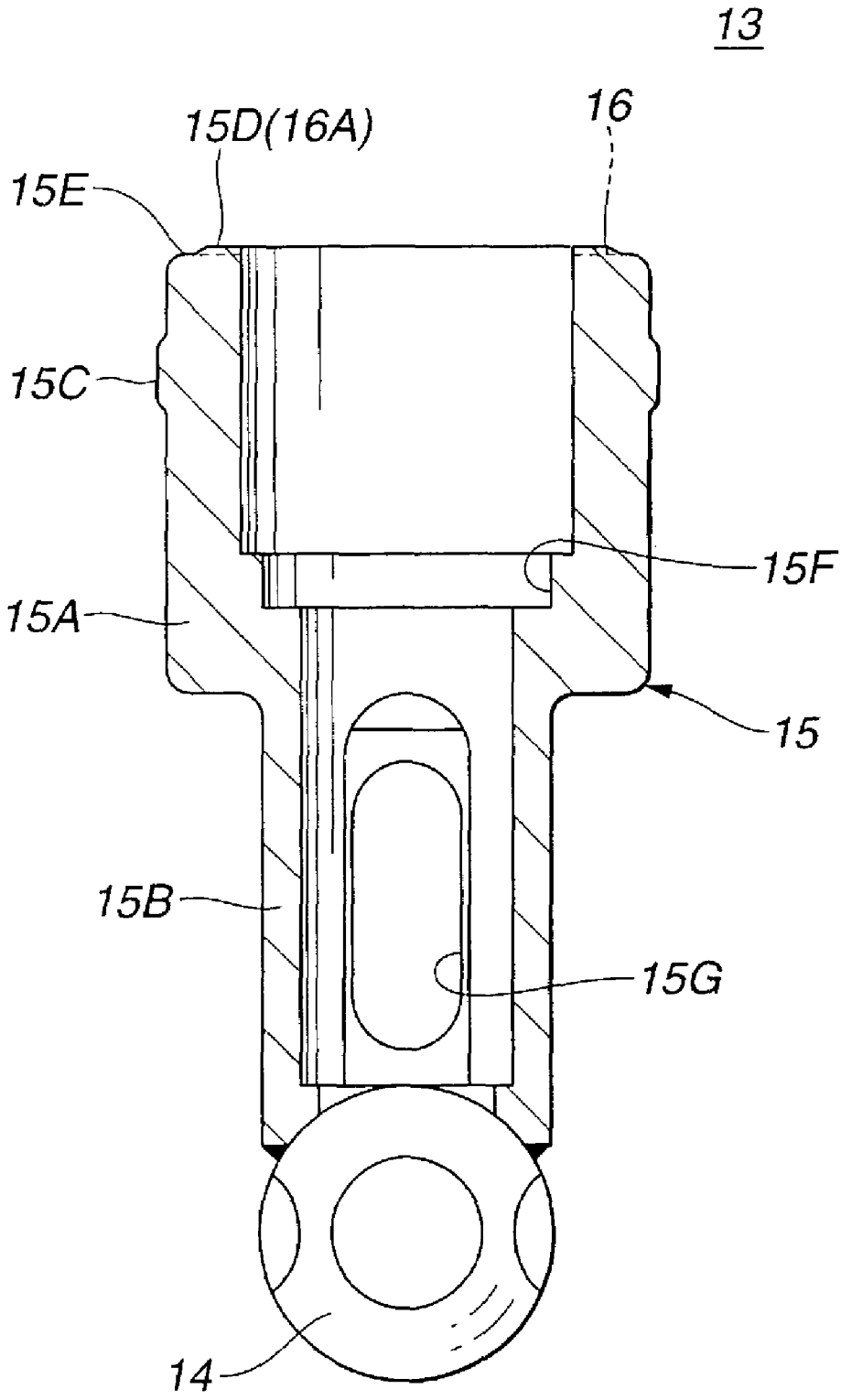
FIG. 3 is an enlarged sectional view of a valve element employed in the fuel injection valve of the invention.

As is understood FIGS. 2 and 3, structural base 15 of valve element 13 comprises the larger diameter upper part 15A that axially slidably contacts with the inner surface of smaller diameter lower portion 2C of metal case 2 and a smaller diameter lower part 15B that extends downward from larger diameter upper part 15A to spherical valve head 14. Spherical valve head 14 is welded to a lower end of smaller diameter lower part 15B.

Structural base portion 15 is produced by a magnetic metal through MPIM (viz., metal powder injection molding) method. As will be described in detail hereinafter, for producing the cylindrical structural base 15, powder of magnetic metal is injected into a mold together with a suitable binder to produce a cylindrical green compact and then the green compact is sintered for production of a finished product, viz., the structural base 15. Preferably, in the present invention, the relative density of metallographic structure of structural base 15 is within a range from about 95% to about 98%.

As is seen from FIG. 3, larger diameter upper part 15A of structural base 15 is formed with a concentric annular ridge 15C. Thus, the slidable contact between upper part 15A of structural base 15 and the inner surface of smaller diameter lower portion 2C of metal case 2 is mainly carried out through the annular ridge 15C.

Figure 6:
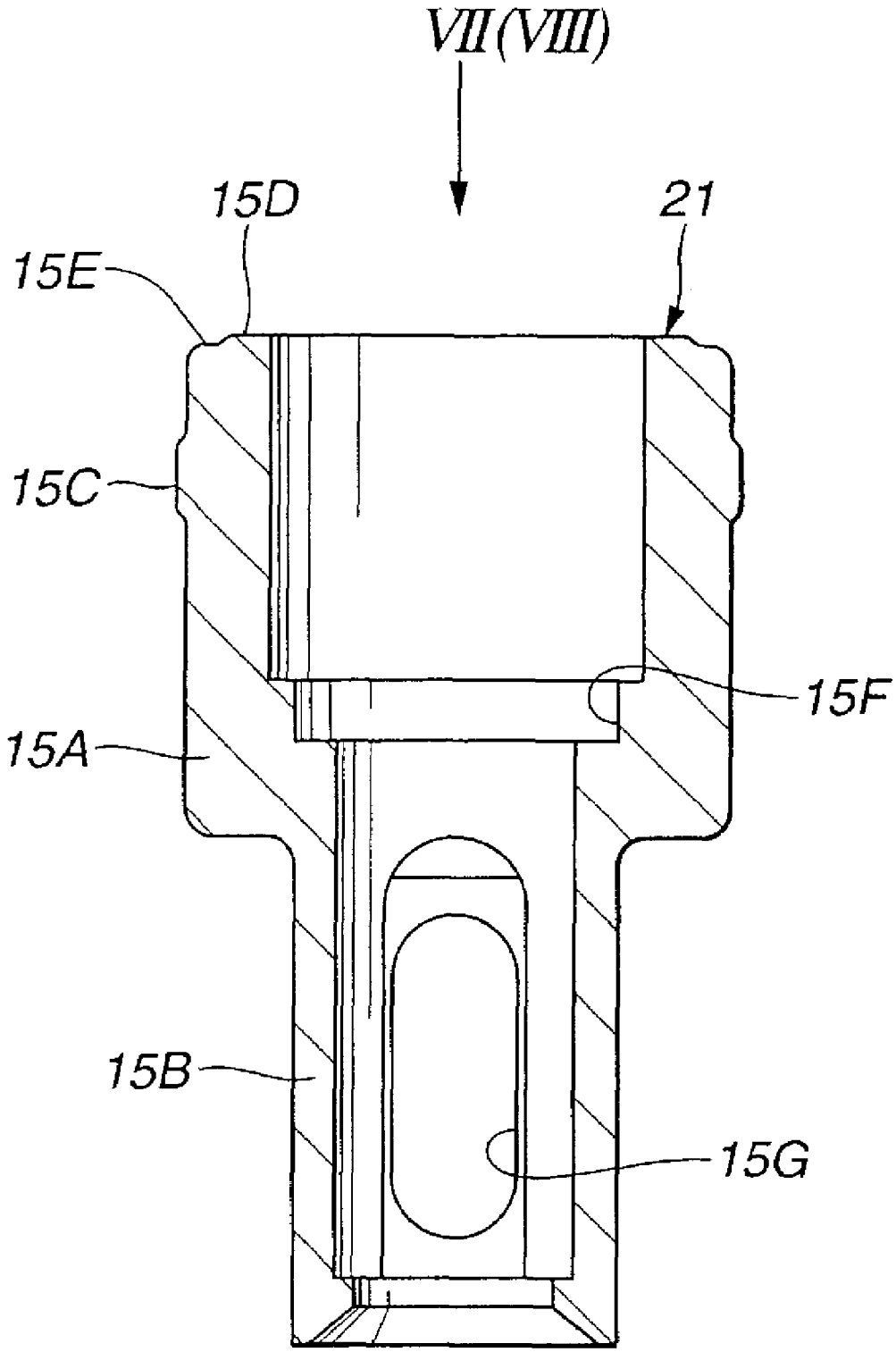
FIG. 6 is an enlarged section view of the unfinished structural base to which a grinding working has been applied.
Figure 7:
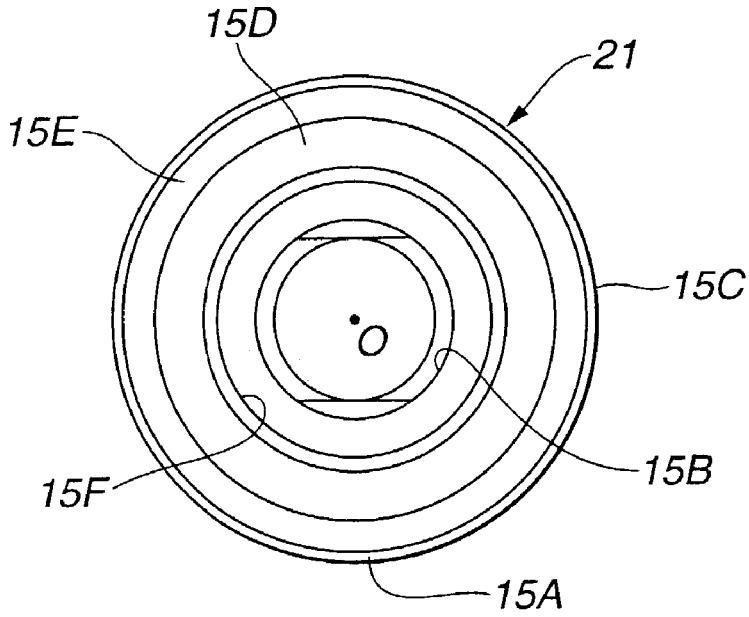
FIG. 7 is a plan view taken from a direction of the arrow "VII" of FIG. 6, showing the unfinished structural base to which the grinding working has been applied.
Figure 8:
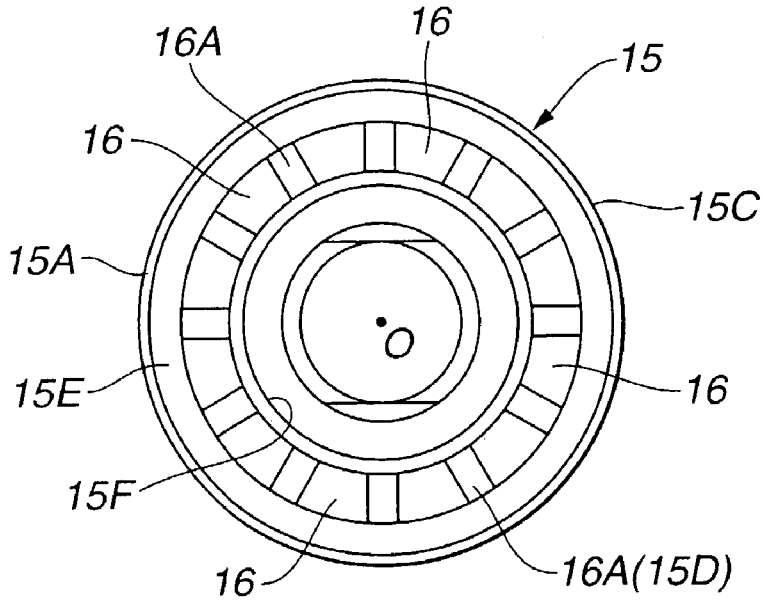
FIG. 8 is a view similar to FIG. 7, but showing the structural base that has been finished by a press working.

As is seen from FIGS. 6 and 7, the upper annular end of larger diameter upper part 15A of cylindrical structural base 15 is formed with a concentric annular land 15D leaving therearound an annular recess 15E. Such upper end of the part 15A is produced by using a grinding working, as will be described hereinlater. As is seen from FIG. 8, by applying a press working to the upper end of the part 15A, many notches 16 are provided in the annular land 15D, each having the same level as annular recess 15E. Due to provision of notches 16, many projected portions 16A are provided, each being defined between adjacent two notches 16. Preferably, projected portions 16A or notches 16 are arranged to extend around an axis of cylindrical structural base 15. In the illustrated embodiment, projected portions 16A or notches 16 are arranged at evenly spaced intervals and extend radially outward, as shown.

Because of provision of notches 16 at the annular land 15D, undesired sticking of the upper annular end of the structural base 15 to the lower annular end of smaller diameter lower part 10B of core tube 10, that would occur when valve element 13 takes its open position, is suppressed.

Such annular recess 15E and notches 16 are easily produced by subjecting structure base 15 to grinding and press workings, as will be described in detail hereinafter. As is seen from FIGS. 2 and 7, cylindrical upper part 15A of structural base 15 is formed with a cylindrical bore 15F into which a lower part of the coil spring 18 is received. As is understood from FIG. 2, the bore 15F has a diametrically reduced bottom end on which a lower end of coil spring 18 is seated.

As is seen from FIG. 2, smaller diameter lower part 15B of structural base 15 is formed, at diametrically opposed portions of the cylindrical wall thereof, with elongate openings 15G through which the pressurized fuel in fuel passage 3 is led toward valve head 14.

As is seen from FIGS. 1 and 2, a tubular spring seat member 17 is tightly received in core tube 10, which has a lower end against which the upper end of coil spring 18 abuts. As shown, coil spring 18 is compressed between valve element 13 and spring seat member 17, and thus valve element 13 is biased downward, that is, toward a close position.

As is seen from FIG. 2, when electromagnetic coil 7 is de-energized, spherical valve head 14 of valve element 13 is hermetically seated on valve seat 11B of valve seat member 11 due to the biasing force of coil spring 18. Under this close position of valve element 13, there is left the given space "S" between the upper end of cylindrical upper part 15A of valve element 13 and the lower end of smaller diameter portion 10B of core tube 10.

When, as has been mentioned hereinabove, electromagnetic coil 7 is energized, there are generated the closed magnetic circuits "H" through metal yoke 5, core tube 10, structural base 15 and their interconnected parts. Upon generation of the circuits "H", structural base 15 is lifted against the biasing force of coil spring 18 by a distance provided by the given space "S". Thus, spherical valve head 14 is released from valve seat 11B of valve seat member 11.

In the following, steps of producing the cylindrical structural base 15 of valve element 13 will be described with reference to FIGS. 4 to 8.

Figure 4:
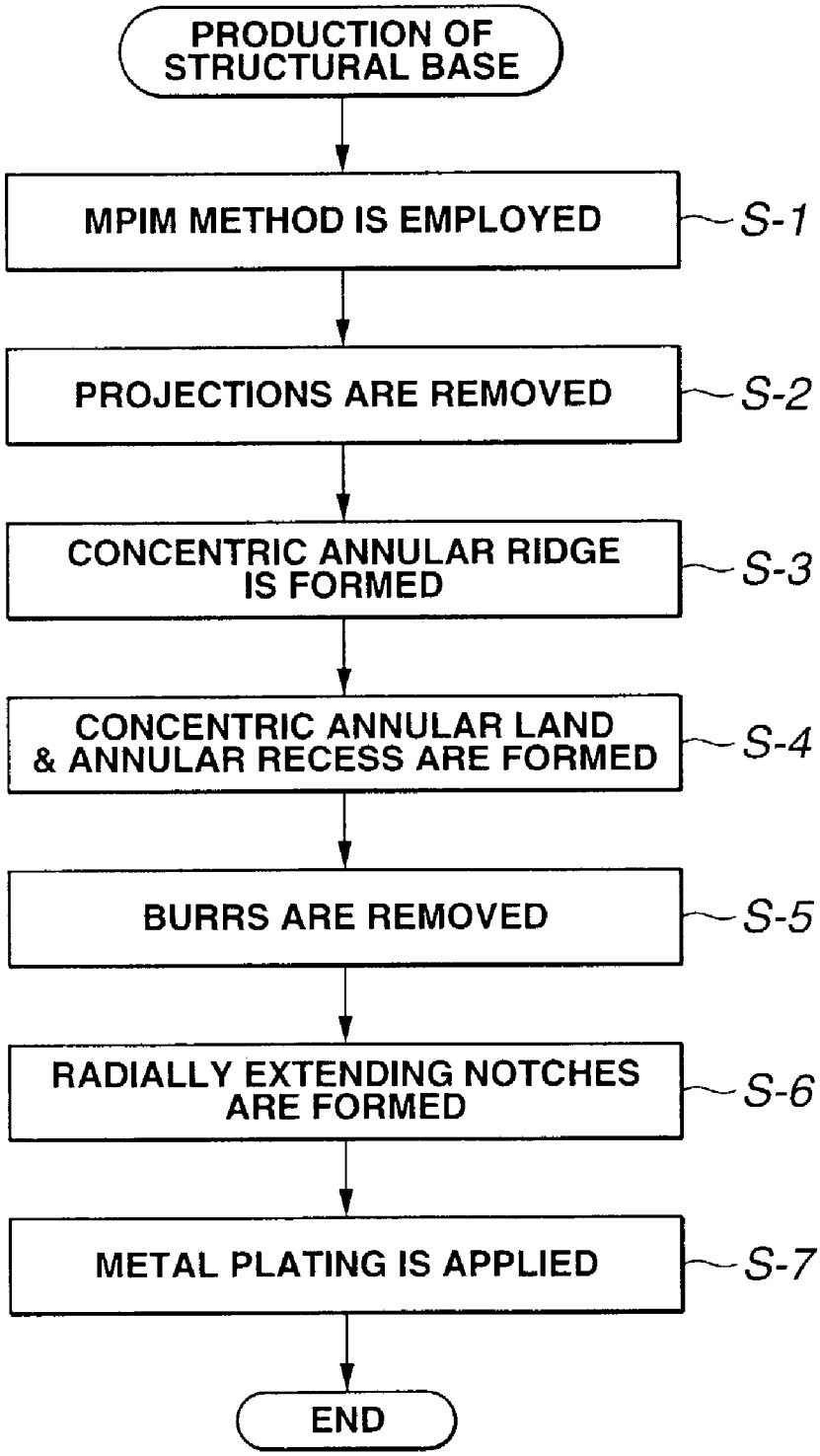
FIG. 4 is a flowchart depicting steps for producing a structural base of the valve element.

Referring to FIG. 4, there is shown a flowchart that depicts steps of production of the structural base 15.

Figure 5:
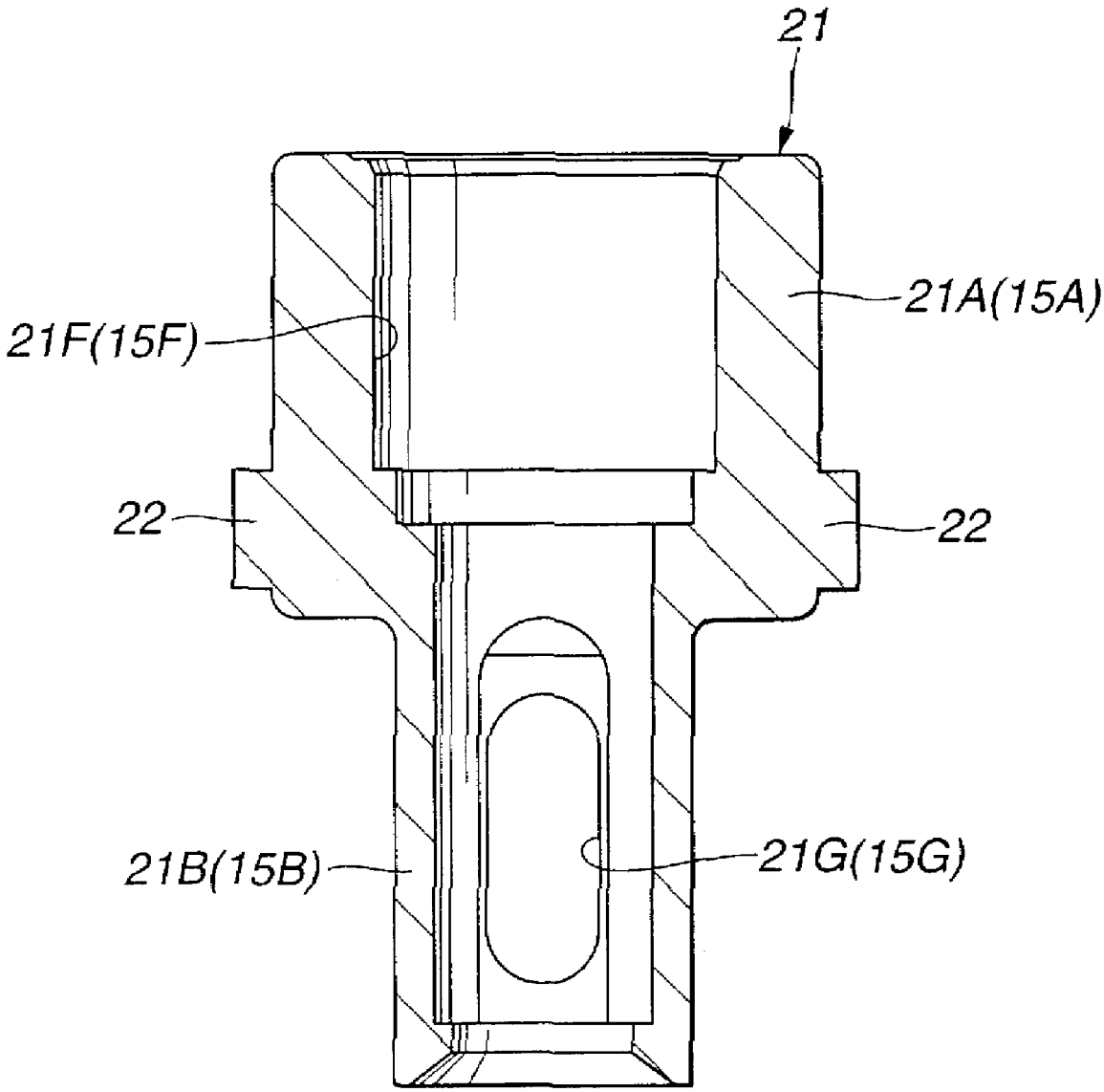
FIG. 5 is an enlarged sectional view of an unfinished structural base that has been produced through MPIM (viz., metal powder injection molding) method.

At step S-1, a so-called metal powder injection molding method (viz., MPIM method) is used. That is, powder of magnetic metal is injected into a mold together with a binder to produce a shaped green compact 21 which is shown in FIG. 5. The binder includes power of plastic and a suitable amount of wax. For the injection, the mixture composed of the powder of magnetic metal and the binder has been heated for melting the binder. Once the green compact 21 in the mold has a certain hardness due to sufficient curing of the binder, the same is released from the mold.

As shown in FIG. 5, due to the nature of MPIM method, the shaped green compact 21 has, on a cylindrical upper part 21A corresponding to the above-mentioned cylindrical upper part 15A, projected portions 22 (two in the illustrated example) that were caused by gates possessed by the mold. Furthermore, the shaped green compact 21 has a smaller diameter lower part 21B corresponding to the smaller diameter lower part 15B, a cylindrical bore 21F corresponding to the cylindrical bore 15F, and elongate openings 21G corresponding to the elongate openings 15G.

The green compact 21 is put into a degreasing oven for removing the binder therefrom, and then put into a sintering furnace for sintering the green compact 21. With this, a sintered compact 21, but unfinished, is produced. Preferably, in the sintered compact 21, the metallographic structure has a relative density ranging from about 96% to about 98%. This means that the sintered compact 21 has a porosity of about 2% to about 5%, that is substantially defined by closed cells.

Referring back to the flowchart of FIG. 4, at step S-2, the projected portions 22 (see FIG. 5) of the unfinished sintered compact 21 are removed or cut off through a cutting working. At step S-3, a grinding working is applied to an entire construction of the unfinished sintered compact 21. By these workings, the concentric annular ridge 15C (see FIG. 6) is left on larger diameter upper part 15A.

Then, at step S-4, as is seen from FIGS. 6 and 7, a grinding working is applied to an upper annular end of larger diameter upper part 15A to produce thereon the above-mentioned concentric annular land 15D and annular recess 15E. Then, at step S-5, cutting and/or grinding working further applied to the sintered compact 21 to remove burrs that would be left thereon.

Then, at step S-6, a press working is applied to the upper annular end of larger diameter upper part 15A on which concentric annular land 15D has been produced. With this press working, the above-mentioned plurality of notches 16 are formed in the land 15D leaving the evenly spaced projected portions 16A on the upper end surface of larger diameter upper part 15A (see FIG. 8).

Then, at step S-7, the sintered compact 21 is subjected to a metal plating process, such as hard chromium plating process or the like, to produce a finished sintered compact, that is, the structural base 15.

Then, as is seen from FIG. 3, spherical valve head 14 is fixed to the lower end of smaller diameter lower part 15B of structural base 15 by means of laser beam welding or the like. With this, production of valve element 13 is completed.

In the following, operation of the fuel injection valve of the present invention will be described with reference to the drawings, especially FIGS. 1 and 2.

For ease of understanding, explanation will be commenced with respect to close condition of the fuel injection valve.

Under this condition, electromagnetic coil 7 is kept de-energized, and spherical valve head 14 of valve element 13 is hermetically seated on valve seat 11B of valve seat member 11 as is well shown in FIG. 2. Thus, the pressurized fuel from the fuel pump (not shown) is kept in cylindrical fuel passage 3 of metal case 2.

When, now, electromagnetic coil 7 is energized, there are generated closed magnetic circuits "H" through metal yoke 5, core tube 10, structural base 15 and their interconnected parts, each circuit passing through the given space "S" defined between structural base 15 and core tube 10. Upon this, valve element 13 is lifted releasing valve head 14 thereof from valve seat 11B, causing the fuel injection valve to assume open condition. Accordingly, the pressurized fuel in cylindrical fuel passage 3 is injected into a given space, such as a combustion chamber, air intake passage or the like, of the internal combustion engine through injection nozzles 12A of nozzle plate 12.

When then electromagnetic coil 7 is de-energized, the closed magnetic circuits "H" disappears and thus valve element 13 is moved down due to the biasing force of coil spring 18. Thus, valve head 14 is seated on valve seat 11B causing the fuel injection valve to take the close condition again.

In the following, advantageous features of the present invention will be described.

As is described hereinabove, the cylindrical structural base 15 of valve element 13 is produced through the metal power injection molding method (viz., MPIM method). With this, the unfinished sintered compact 21 can have a porosity of about 2% to about 5%, that is defined by closed cells. This porosity from 2% to 5% brings about the following advantage.

That is, for finishing sintered compact 21, a press working is applied to the upper annular end of larger diameter upper part 15A of sintered compact 21. However, as has been mentioned at the section of the known technique, such press working tends to induce a deformation or swelling of the part to which the pressing force is actually applied. However, in the present invention, the porous structure of sintered compact 21 in the range of porosity from about 2% to about 5% prevents the upper annular end of structural base 15 from suffering such deformation or swelling.

That is, due to the porous structure, the deformation or swelling, that would be produced on the upper annular end, is advantageously absorbed by the porous structure. It has been found that when the porosity of sintered compact 21 is in a range from 2% to 3% (viz., ranging from 97% to 98% in the relative density of metallographic structure), the best result is obtained.

Accordingly, in the present invention, a finely finished structural base 15 of valve element 13 is obtained without employing additionally a finish machining working. Thus, the fuel injection valve of the present invention has a high productivity and cost performance of the same is increased.

Although the above description is directed to an example wherein the plurality of nothces 16 formed in annular land 15D (see FIG. 8) extend radially outward, straight and/or curved grooves extending across annular land 15D may be employed.

The entire contents of Japanese Patent Applications 2002-146260 filed May 21, 2002 are incorporated herein by reference.

Although the invention has been described above with reference to the embodiment of the invention, the invention is not limited to such embodiment as described above. Various modifications and variations of such embodiment may be carried out by those skilled in the art, in light of the above description.

What is claimed is:

1. A fuel injection valve comprising:

a cylindrical case constructed of a magnetic metal, said metal case including an upstream end through which a pressurized fuel is led into a fuel passage defined in the metal case and a downstream end from which the fuel is injected to a given portion through fuel injection nozzles;

a core tube constructed of a magnetic metal, said core tube being received in the cylindrical case and having an upstream end facing the upstream end of the cylindrical case and a downstream end facing the downstream end of the cylindrical case;

a valve seat member provided at the downstream end of the cylindrical case at a position upstream of the fuel injection nozzles;

a valve element axially movably received in the cylindrical case between the core tube and the valve seat member, the valve element including a structural base that is directed toward the downstream end of the core tube and a valve head that is directed toward the valve seat member;

a biasing member that biases the valve element toward the valve seat member; and an electromagnetic coil that forces the valve element to move toward the downstream end of the core tube against the biasing force of the biasing member when energized, wherein the structural base of the valve element is a sintered magnetic metal member and has a relative density ranging from approximately 95 % to approximately 98 %, and wherein the structural base has, at an end thereof that is contactable with the downstream end of the core tube, a notched surface for suppressing a sticking of the end of the structural base to the downstream end of the core tube.

2. A fuel injection valve as claimed in claim 1, in which the notched surface includes a plurality of notches.

3. A fuel injection valve as claimed in claim 2, in which the structural base is cylindrical in shape and the plurality of notches of the notched surface are arranged to extend around an axis of the structural base.

4. A fuel injection valve as claimed in claim 3, in which the plurality of notches of the notched surface are arranged at evenly spaced intervals and extend radially outward.

5. A fuel injection valve as claimed in claim 1, in which the relative density of the structural base is in a range from approximately 97 % to approximately 98 %.

6. A fuel injection valve as claimed in claim 1, in which the valve head is welded to the structural base to constitute a united structure of the valve element.

7. A fuel injection valve as claimed in claim 3, in which the downstream end of the core tube is defined by an annular edge of the core tube, the end of the cylindrical structural base contactable with the downstream end of the core tube is defined by an annular edge of the cylindrical structural base, and the notched surface is formed on the annular edge of the cylindrical structural base.

* * * * *